United States Patent [19]

Peters

[11] 4,377,021

[45] Mar. 22, 1983

[54] APPARATUS FOR OPENING AND MIXING FIBROUS MATERIAL, E.G. COTTON

[75] Inventor: Franz Peters, Dülmen, Fed. Rep. of Germany

[73] Assignee: Hergeth KG Maschinenfabrik und Apparatebau, Dülmen, Fed. Rep. of Germany

[21] Appl. No.: 174,872

[22] Filed: Aug. 4, 1980

[30] Foreign Application Priority Data

Aug. 3, 1979 [DE] Fed. Rep. of Germany ..... 2931500

[51] Int. Cl.[3] ..... D01G 13/00

[52] U.S. Cl. ..... 19/80 R; 19/81; 19/145.5

[58] Field of Search ..... 19/80 R, 97.5, 145.5, 19/81, 105, 300, 304, 305; 406/109, 114, 116, 154, 164, 165, 167

[56] References Cited

U.S. PATENT DOCUMENTS

| | | | |
|---|---|---|---|
| 1,605,196 | 11/1926 | Ligon | 406/167 X |
| 1,717,633 | 6/1929 | Stevens | 19/145.5 |
| 2,920,355 | 1/1960 | Clark | 19/300 X |
| 3,689,119 | 9/1972 | Weichel | 406/167 X |
| 3,717,904 | 2/1973 | Bonner et al. | 19/105 X |
| 3,736,624 | 6/1973 | Alt et al. | 19/80 R |
| 3,795,943 | 3/1974 | Eckrodt | 19/80 R |
| 4,100,651 | 7/1978 | Wornall et al. | 19/81 X |
| 4,190,933 | 3/1980 | Jagst | 19/145.5 |
| 4,264,241 | 4/1981 | Höck | 406/167 |

FOREIGN PATENT DOCUMENTS

| | | | |
|---|---|---|---|
| 2800714 | 7/1979 | Fed. Rep. of Germany | 19/80 R |
| 23267 | of 1893 | United Kingdom | 19/105 |
| 1228793 | 4/1971 | United Kingdom | 19/145.5 |
| 2054680 | 2/1981 | United Kingdom | 19/80 R |

*Primary Examiner*—Louis Rimrodt

*Attorney, Agent, or Firm*—Diller, Ramik & Wight

[57] ABSTRACT

An apparatus for opening and mixing fibrous materials including a conveyor for moving bales of fibrous material along a generally horizontal path toward an inclined surface, means moving along the surface or the inclined path of travel of the conveyor for removing fibrous material from the bales, the removing means being, for example, a teasing roll which is connected by telescopic and/or flexible ducts to an extractor fan which discharges the removed fibrous material into a bin having in a lower portion thereof a conveyor belt which is driven to maintain the fibrous material within the bin at a generally constant uniform level, and a discharge conveyor for removing the fibrous material from the bin for subsequent processing.

16 Claims, 4 Drawing Figures

APPARATUS FOR OPENING AND MIXING FIBROUS MATERIAL, E.G. COTTON

The present invention relates to an apparatus for opening and mixing fibrous material, such as cotton and the like in which bales of the fibrous material are moved along a generally horizontal plane by a conveyor and while being thus moved, the fibrous material within the bales is opened and/or broken down and/or removed by a reciprocating reduction device in the form of a teasing roll whereupon the fibrous material thus removed can be conveyed toward and into a bin in which it is further mixed and from which it can be discharged for subsequent operation.

The fibrous material contained in fiber bales may be carried out as follows in keeping with the present invention. The fibrous material bales are assembled preferably one behind the other along a horizontal path of travel and a reducing device in the form of a teasing roll is moved in a reciprocating fashion along opened tops or opened bottoms of the bales whereupon the fibrous material is opened and removed either along an inclined surface or along a horizontal surface depending upon the particular construction of the apparatus. The teasing roll or similar reducing device can move along an inclined path across upper ends of the bales of fibrous material or along lower opened ends of the fibrous bales but, in this case, movement of the teasing roll or the carriage carrying the same is along a horizontal path. The opened material or the material removed from the bales is transported preferably by a pneumatic or suction feed device, although a conveyor belt might be utilized in lieu thereof. The opening or removing of the fibrous material by the teasing roll initially loosens the fibrous material and creates a certain mixing effect which continues during its transport to an eventual collection bin. The loosened fibrous material thus collected in the collection bin is subsequently transferred or fed to a carding or hatchelling machine by a hopper-feeder of a known construction.

Large capacity hopper-feeders are known in which the material, spread out upon a conveyor belt, is removed at a discharge end of the conveyor belt by a needle-feed-lattice device (conveyor). Such hopper-feeders also fulfill a mixing function of the fibrous material.

In keeping with a primary object of this invention, the novel opening and mixing apparatus is essentially a bale-opener unit associated with a large-capacity hopper-feeder which collectively considerably improves the mixing effect on fibrous material before the fibrous material is conveyed to a processing machine. As compared to conventional apparatus, the invention is characterized in that bales of fibrous material are conveyed in a row or file toward an oblique plane along which a teasing roller is moved or reciprocated, and the fibrous material thus removed is then transferred to collecting means in the form of a mixer bin or bed having a lower end defined by an upper flight of a moving conveyor disposed in an oblique plane which permits the material to be transferred toward a discharge end of the mixer bed at which the collected fibrous material is at its maximum height.

In practicing the invention as latter-described, the fibrous material, having been loosened during the opening or removal thereof from the associated bales, is to a certain extent premixed both during the opening operation and during its transport to the collection or mixer bed or bin. Thus, the removed, opened and mixed material is deposited in the mixer bed in generally a loose accumulation, and it is generally collected above the conveying means for the bales and at a length corresponding generally thereto. Furthermore, because of the conveyor forming in effect the bottom wall of the mixer bed or bin, the fibrous material therein is further admixed as it moves by the conveyor from a shallow end to a deeper end of the mixer bin at which the material is discharged for subsequent processing. The latter movement insures a more intense mixing effect on the fibrous material before the same is passed to a processing machine thereby insuring a considerable saving of time.

By removing the fibrous material from the bales which are conveyed in a roll or line and by simultaneously discharging the material from the mixer bin in preferably a vertical direction, the mixing effect on the fibrous material is almost directly doubled, as compared to conventional mechanisms, which has an extremely beneficial effect during the subsequent processing of the fibrous material. Furthermore, due to the sequence of operations, there is an improvement in the quality of the material because it is more thoroughly opened and mixed prior to being processed, and this is accomplished by a relatively compact apparatus due to the utilization of the specific components thereof. For example, it has been noted that in large capacity hopper-feeders, the material within the mixer bed or bin often forms a sloping surface which is caused by the fact that the fibrous material moves toward and builds up at a discharge end of the bin adjacent the conventional discharge device simply because the feed of the fibrous material in the bin is slower than the discharge of the fibrous material therefrom by the typical needle-feed-lattice mechanism. Therefore, the material is built up at its maximum at the discharge end of the bin and is thinnest at the inlet end of the mixer bin. However, by inclining the mixer bin conveyor belt such that the discharge mechanism, be it a needle-feed-lattice discharge mechanism, is located at the deepest end of the mixer bin a compact apparatus is obtained with attendant efficiency and economy in discharge opertion, floor space economy, etc.

In further accordance with this invention, the floor of the mixer bed or bin, that is to say the upper run of the conveyor belt heretofore noted which moves the material toward a discharge device of the mixer bin, is preferably arranged not only at an oblique angle or an inclined angle, but one which also corresponds to the slope along which the tease roller or the bale opening device moves relative to the bales being fed thereto. While the practice is known whereby the rows of bales move and are opened along an oblique plane or are opened along an underside thereof along a horizontal plane, the utilization of either of these concepts together with a mixer bed or bin having an inclined conveyor belt as its bottom wall with a discharge from the deepest end is not known.

It is also advantageous to obviously coordinate the entire operation of the apparatus such that the level of the fibrous material in the mixer bin is maintained constantly approximately horizontal. This arrangement ensures that there is a uniform rate of discharge of the fibrous material from the mixer bed or bin which is receiving constant accretions.

The teasing roll or like opening or reducing mechanism for the fiber material bales is preferably connected to a pneumatic conveying system which includes one or more telescopic and/or flexible tubes having a cyclonic separator at the discharge end thereof, and preferably the cyclonic separator is reciprocated along an upper end of the mixer bed to discharge the fibrous material therein in a uniform fashion such as to maintain the upper surface of the material in the mixer bed at a uniform generally horizontal height.

As the fibrous material within the mixer bed or bin is conveyed from its end of least height to its end of greatest height, the fibrous material is further mixed and eventually is discharged by a generally vertical flight of a needle-feed-lattice conveyor which is also preferably associated with a stripper roller or the like. All of these structures are, of course, combinated in a common housing so that the overall apparatus carries out all of the functions described in a minimum of space. The resulting structures is, therefore, a most compact one and avoids the use of inline devices which require extensive floor space or working areas.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
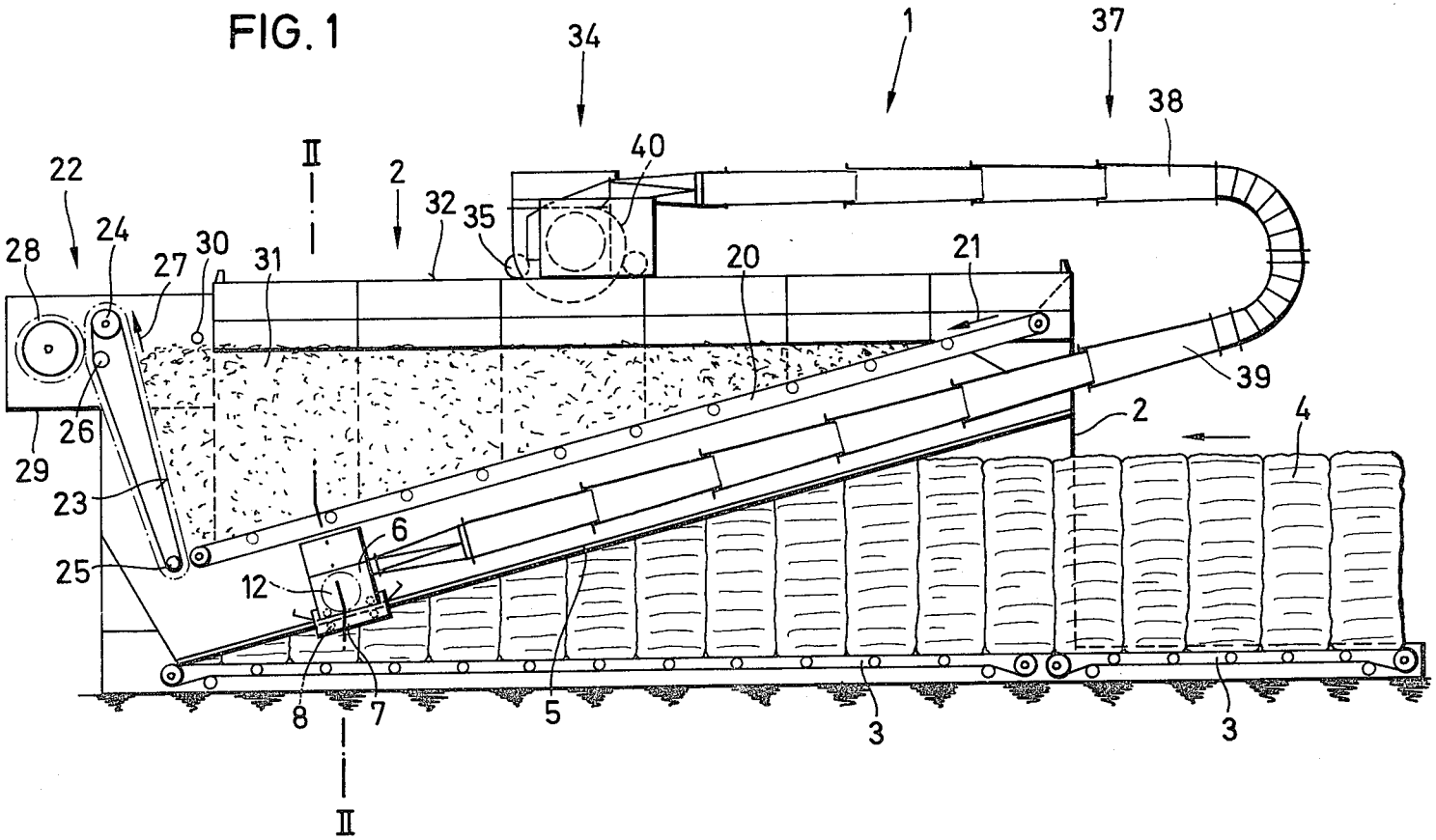
FIG. 1 is a side elevational view of a novel apparatus of this invention, and illustrates conveyors moving bales of fibrous material toward an oblique wall along which moves a rotating teasing roller for removing fibrous material from the bales and conveying themselves through a pneumatic conveyor to a collecting bin which includes an inclined conveyor and a discharge conveyor.
Figure 2:
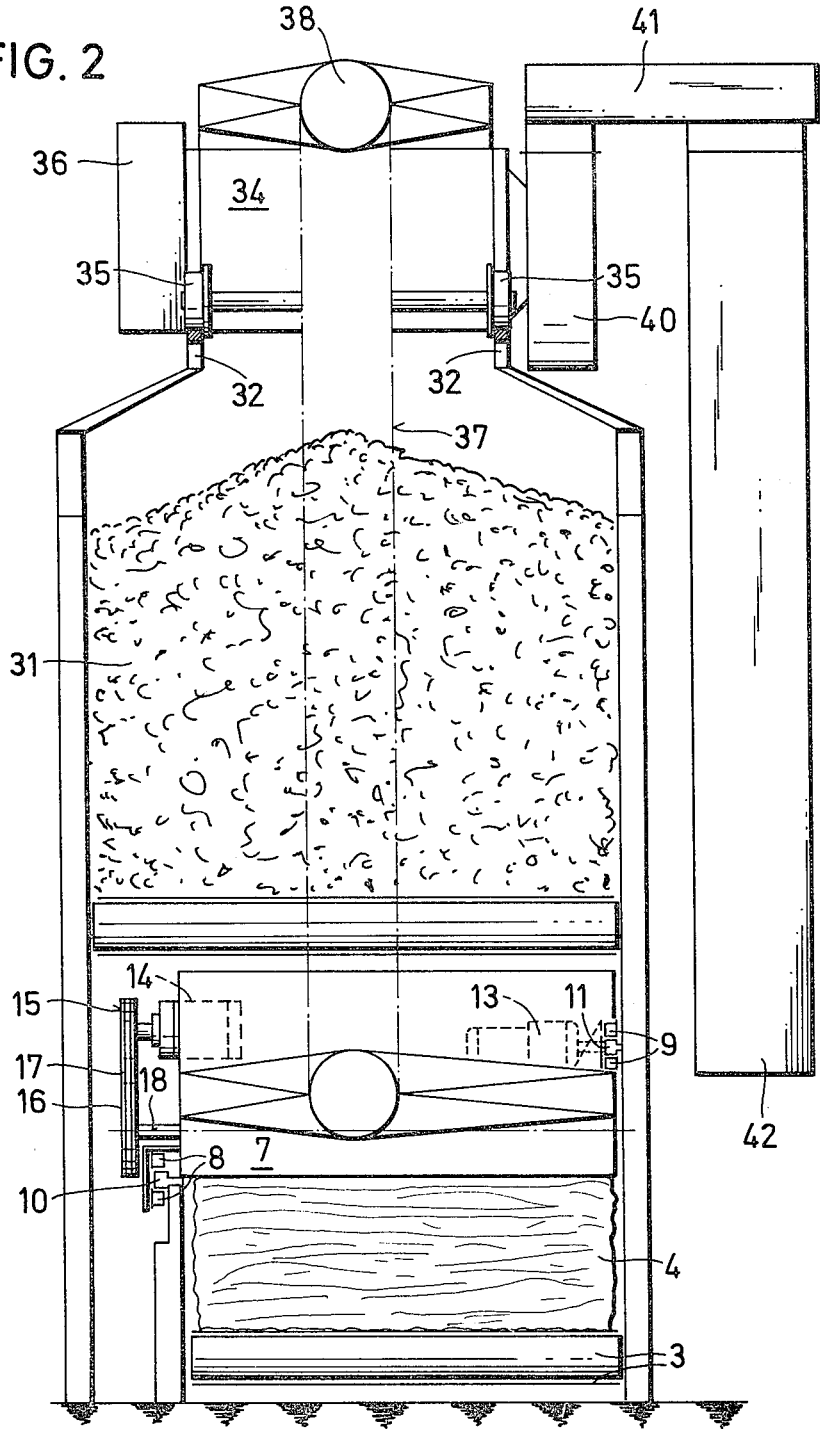
FIG. 2 is a sectional view taken generally along line II—II of FIG. 1, and illustrates further details of the apparatus.

A novel opening and mixing apparatus constructed in accordance with this invention is illustrated in FIGS. 1 and 2 and is generally designated by the reference numeral 1. The purpose of the opening and mixing apparatus 1 is to remove fibrous material, such as cotton, from a plurality of individual bales 4 as the same are moved from right-to-left in FIG. 1 along a predetermined path of travel established by a plurality of generally horizontally disposed conveyors 3. The conveyors or conveyor belts move the bales 4 in a line or row through an opening (unnumbered) in a housing 2 of the apparatus 1 against an obliquely disposed screen, grate or grill 5 through which the fibrous material can be opened or removed by means of a travelling reducing device or opening device 6. The reducing device 6 includes a carriage 7 having track wheels 8 (FIG. 1) and 9 (FIG. 2) which ride on respective tracks or rails 10, 11 (FIG. 2). The reducing device 7 includes means in the form of at least one horizontally mounted rotatably driven teasing roll 12 which can move up and down or to-and-fro along the inclined screen or plane 5. The overall reducing device 7 is bodily moved along the tracks 10, 11 by a motor 13 (FIG. 2) which imparts selective reversible drive to the rollers 9 so that the entire housing 7 can at one time be moved up along the inclined grate or grill 5 or down the same grate or grill 5 in a continuing reciprocal to-and-fro motion. The teasing roll 12 which defines the means for opening the fibrous material exposed to the grill 5 is driven or rotated by a shaft 18 from a motor 14 by means of conventional pulleys 15, 16 and a drive belt or pulley belt 17 entrained thereabout.

Within the housing 2 is means in the form of a conveyor belt 20 whose upper flight moves fibrous material within collecting means 31 for the fibrous material in the direction of the headed arrow 21 which is inclined generally downwardly and to the left in FIG. 1. Preferably, the conveyor 20 is inclined at an angle corresponding to that of the surface, grill or screen 5 along which the reducing device 6 is reciprocated in the to-and-fro fashion earlier described.

At the left end (unnumbered) of the housing 2, as viewed in FIG. 1, there is provided discharge means in the form of a vertical discharge device 22 whose innermost run (unnumbered) travels in a generally upwardly vertical position, as indicated by the headed arrrow 27 associated therewith. The vertical discharge device 22 is in the form of a needle-feed-lattice mechanism 23 which is entrained about appropriate deflection rollers 24, 25 and 26, anyone of which is appropriately conventionally driven, as is a stripper roller 28 which cooperates in a conventional manner with the needle-feed-lattice mechanism 23. A discharge area 29 is provided beneath the stripper roller 28 at which the fibrous material in its opened and thoroughly mixed state is discharged from the stripper roller, collected by a movable conveyor or other device and thence conveyed to appropriately processing machinery. Means in the form of a feeler mechanism 30 is utilized for detecting the height of fibrous material within a mixing bed or bin defined by the housing 2 which includes as a bottom "wall" thereof the upper run (unnumbered) of the conveyor belt 20. The feeler mechanism 20 is utilized to controll the various drives including that of a conveyor 20 to maintain the fibrous material within the mixer bed or bin 31 at a constant generally uniform horizontal height or level.

Means 37 are provided for transferring the fibrous material removed from the fiber bales 4 by the teasing roller 12 from the reducing device 6 to conveyor means in the form of a pneumatic travelling cyclonic separator 34 which is mounted on rails 32 (FIG. 2) of the housing 2 and moves horizontally in a reciprocal fashion upon the rails 32 by means of wheels 35. The cyclonic separator 34 is driven by a conventional motor 36 in its reciprocating horizontal path on the rails 32. The transfer device 37 between the reducing device 6 and the cyclonic separator 34 may include, for example, a plurality of telescopic tubes or ducts 38, 39 so constructed that they might extend or retract telescopically with a flexible section (unnumbered) of ducts therebetween. Preferably, the cyclonic separator 34 includes as a part thereof an evacuating or extractor fan 40 so that the housing of the cyclonic separator 34 serves as a suction chamber to draw the loosened and opened fibrous material from the area of the teasing roll through the ducts 39, 38 into the housing of the cyclonic separator and thence into the mixing bin 31. The exhaust air from the extractor fan 40 enters a duct 41 (FIG. 2) containing conventional filters and filter pockets 42 wherein the air is purified.

In operation, the fiber bales 4 are placed upon the conveyor or conveyors 3, and the latter convey the bales from right-to-left against the inclined grill or screen 5 through which the fibrous material is drawn from the bales by the teasing roll 12 of the reducing device 6. The thus opened and removed material is further conveyed through the pneumatic ducts 38, 39 to and through the cyclonic separator 34 with, of course, both the reducing device 6 and the cyclonic separator 34 being reciprocated to-and-fro during the operation of the apparatus 1 while at the same time, both the conveyor belt 20 and the discharge device 22 are operating to discharge fibrous material from the mixing bin 31. As is most evident in FIG. 1, the material builds up and admixes within the mixing bin 31 and the length of the latter from its shallowest point to its deepest point corresponds generally to the distance or length of the grill or screen 5 therebeneath along which travels the reducing device 6. In other words, the treating zone or length of the reducing device 6 or its path of reciprocal movement is essentially the same as the length of travel of the upper flight of the conveyor 20 which obviously constitutes an extremely compact arrangement when the mixing bin 31 is disposed in effect atop the mechanisms housed beneath the conveyor belt 20 thereof.

The quantity of the opened fibrous material, the movement of the cyclonic separator 34, the movement of the conveyor belt 20, the movement of the conveyors 3, etc. are preferably so coordinated that the surface of the material within the mixer bin in the upper portion of the housing 2 remains approximately horizontal, as is illustrated in FIG. 1. Furthermore, due to the telescopic and flexible nature of the transfer means 37 including the telescopic ducts 38, 39 thereof, the reducing device 6 and the cyclonic separator 34 may be moved independently of each other or jointly of each other, depending upon the particular operations to be performed, the speed at which they are to be preformed, etc. However, the fibrous material discharged at the point or area 29 will have by the time it has discharged undergone a double mixing operation by virtue of the fact that it is mixed as it is conveyed through the transfer means 37 and is also mixed during its discharge into, its travel along and its discharge from the mixing bin 31. Furthermore, the mixer or mixing bed or bin 31 also serves as a hopper-feeder due to the utilization therein of the discharge mechanism, means or needle-feed-lattice mechanism 23.

Figure 3:
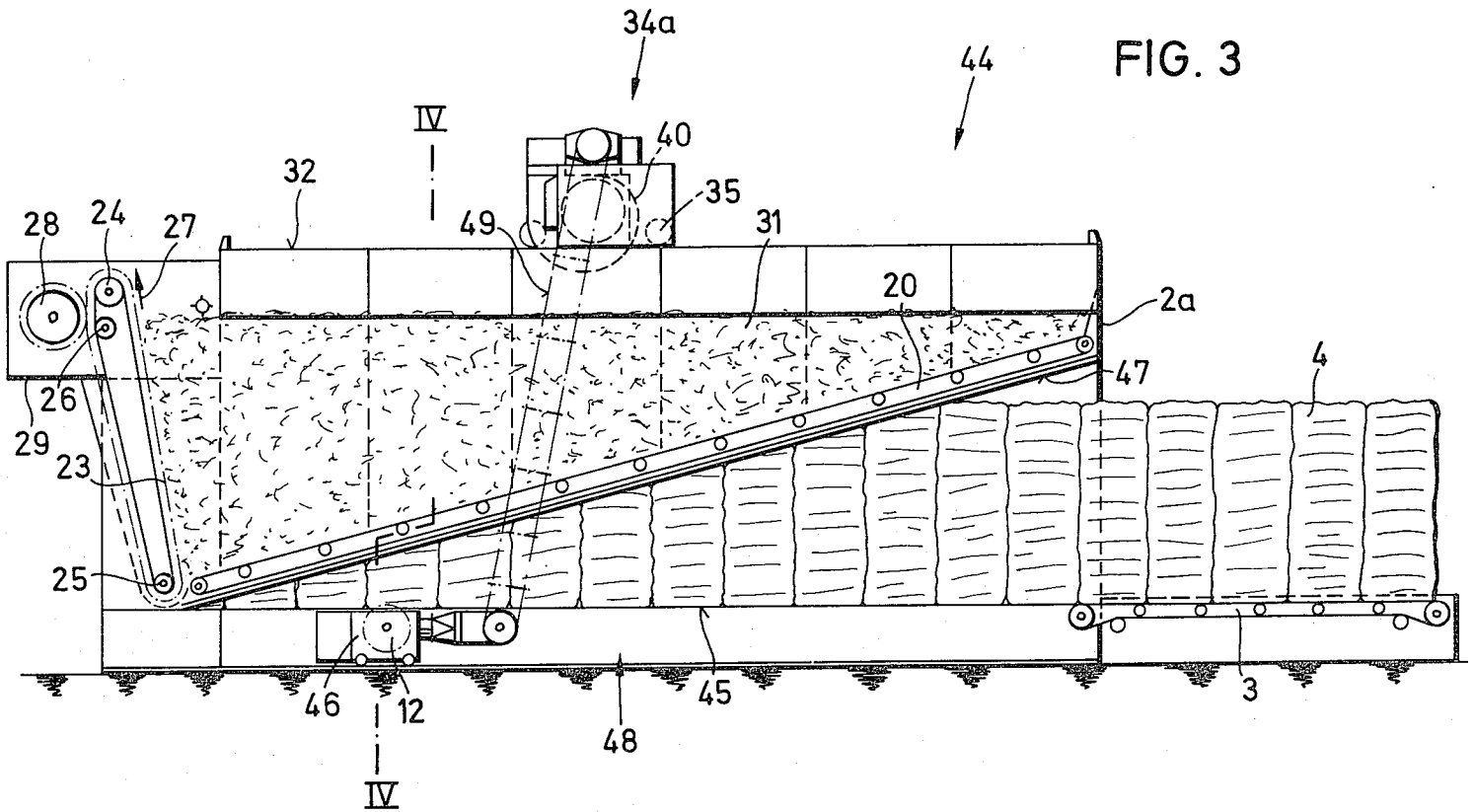
FIG. 3 is an elevational view of another apparatus of this invention, and illustrates a teasing roll moved horizontally along lower ends of bales supported upon a grill to remove fibrous material therefrom.
Figure 4:
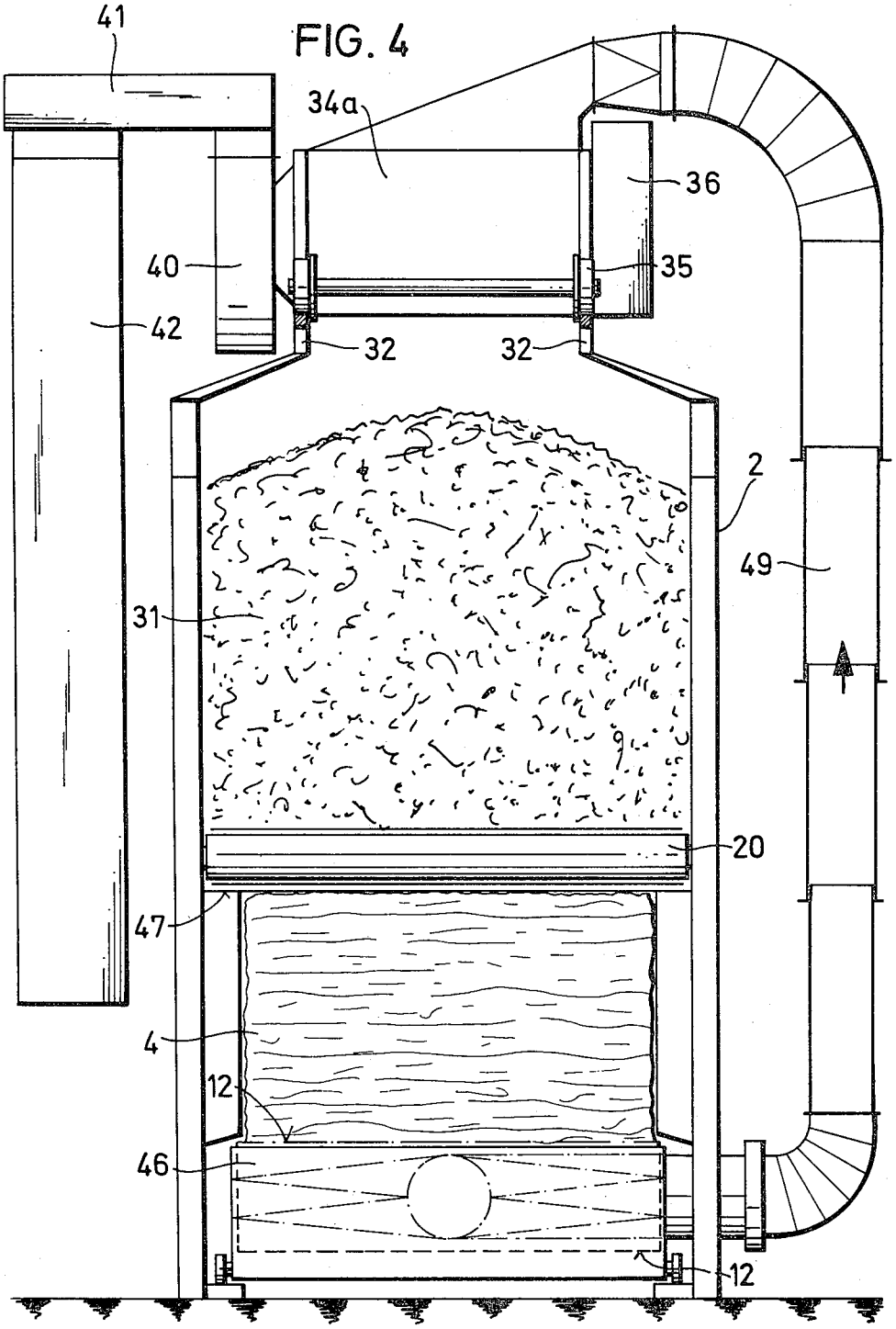
FIG. 4 is a cross-sectional view taken generally along line IV—IV of FIG. 3 and illustrates further details of the apparatus of FIG. 4.

Reference is now made to the apparatus of FIGS. 3 and 4 which is generally designated by the reference numeral 44 and which includes elements corresponding to those of the apparatus 1 of FIGS. 1 and 2 with such corresponding elements bearing identical though primed reference numerals. The apparatus for opening and mixing bales of fibrous material in FIGS. 3 and 4 similarly includes a conveyor 20' forming by virtue of its upper flight (unnumbered) a lower wall of the mixer bin 31'. However, beneath the conveyor 20' is disposed a fixed inclined or obliquely positioned wall 47 which serves as a deflector plate against which are moved the fibrous bales 4' as they are moved from right-to-left in FIG. 3 by a conveyor 3'. Within a housing 2' of the apparatus 44 the fibrous bales 4' travel along a horizontal surface in the form of a grill or screen beneath which is a reducing device 46 having a teasing roll 12' which opens or removes the fibrous material from the bales from lower ends (unnumbered) of the bales through the screens 45. The reducing device 46 is, of course, reciprocated along a horizontal path of travel to or fro, left-to-right, etc. in FIG. 3 along horizontal rails 48 through a drive mechanism corresponding to that of the reducing device 6 of the apparatus 1. Furthermore, the apparatus 44 includes a cyclonic separator 34' which is connected to the reducing device 46 by fibrous material transporting means 49 in the form of relatively telescopic and flexible ducts (FIG. 4) which are individually unnumbered. Thus, the overall operation of the apparatus 44 is essentially identical to the apparatus 1, except that the reducing device 46 travels horizontally and opens or removes the fibrous material from the bales 4 from the bottom thereof as opposed to moving along an inclined plane, as in the case of the apparatus 1 of FIG. 1 which, of course, removes and opens the fibrous material from the upper ends of the bales 4.

Although only a preferred embodiment of the invention has been specifically illustrated and described herein, it is to be understood that minor variations may be made in the apparatus without departing from the spirit and scope of the invention, as defined in the appended claims.

I claim:

1. A system for opening and mixing bales of fibrous material comprising means for feeding bales of fibrous material along a first path of travel in a first direction from an input end toward an end remote therefrom, means for defining an inclined surface against which bales are urged by said feeding means during the movement of said bales in said first direction, said inclined surface having opposite ends disposed remotely from and more closely adjacent to said respective input and remote ends of said path of travel, said inclined surface defining an acute angle with said feeding means, means for removing the fibrous material from the bales thereof, means for moving said fibrous material removing means along a second path of travel during the operation thereof, means above said inclined surface for collecting the removed fibrous material, said collecting means including means for moving the collected fibrous material along a third path of travel in a direction corresponding to said first direction generally parallel to said inclined surface between an input end of said third path toward an end remote therefrom, said first path remote end and third path remote end being contiguous each other, means for discharging the collected fibrous material from said collecting means at an area of maximum depth of the collecting means and the selected fibrous material therein, and said area of maximum depth being located generally above and contiguous said third path remote end.

2. The system as defined in claim 1 including pneumatic means for transferring the removed fibrous material from the removing means to the collecting means.

3. The system as defined in claim 1 including pneumatic means for transferring the removed fibrous material from the removing means to the collecting means, and said pneumatic means includes relatively telescopic ducts.

4. The system as defined in claim 1 including pneumatic means for transferring the removed fibrous material from the removing means to the collecting means, and said pneumatic means includes a flexible conduit.

5. The system as defined in claim 1 including pneumatic means for transferring the removed fibrous material from the removing means to the collecting means, said collecting means having an upper end, said pneumatic means includes a discharge end at said upper end, and means for moving said discharge end along said upper end.

6. The system as defined in claim 1 including means for pneumatically transferring the removed fibrous material from the removing means to the collecting means, said pneumatic transfer means including a fan, duct means between said fan and said removing means, and means for moving said fan along an upper portion of said collecting means.

7. The system as defined in claim 1 including means for pneumatically transferring the removed fibrous material from the removing means to the collecting means, said pneumatic transfer means including a fan, duct means between said fan and said removing means, means for moving said fan along an upper portion of said collecting means, and said duct means includes a plurality of relatively telescopic ducts.

8. The system as defined in claim 1 including means for pneumatically transferring the removed fibrous material from the removing means to the collecting means, said pneumatic transfer means including a fan, duct means between said fan and said removing means, means for moving said fan along an upper portion of said collecting means, and said duct means includes a flexible duct.

9. The system as defined in claim 1 wherein said second path of travel is generally parallel and contiguous said first path of travel.

10. The system as defined in claim 1 wherein said second path of travel is along said inclined surface.

11. The system as defined in claim 1 wherein said second path of travel is along said inclined surface, said inclined surface is spaced from said third path moving means, and said fibrous material removing means moves generally between said inclined surface and third path.

12. The system as defined in claim 1 wherein the bales have upper and lower ends, and said fibrous material removing means removes the fibrous material from the upper ends of the bales.

13. The system as defined in claim 1 wherein the bales have upper and lower ends, and said fibrous material removing means removes the fibrous material from the lower ends of the bales.

14. The system as defined in claim 1 including means for transferring the removed fibrous matrial from the removing means to the collecting means, and means for controlling the operation of said removing means, moving means and transferring means to maintain a generally constant horizontal upper level of the collected fibrous material.

15. The system as defined in claim 1 wherein the fibrous material removing means reciprocates the removing means along said second path.

16. The system as defined in claim 1 wherein said collecting means further includes a collecting den and said collected fibrous material moving means is a conveyor defining a bottom wall of said collecting den.

* * * * *